US006100232A

United States Patent [19]

Capeci et al.

[11] Patent Number: 6,100,232

[45] Date of Patent: Aug. 8, 2000

[54] PROCESS FOR MAKING A GRANULAR DETERGENT COMPOSITION CONTAINING A SELECTED CRYSTALLINE CALCIUM CARBONATE BUILDER

[75] Inventors: Scott William Capeci, North Bend; Eugene Joseph Pancheri, Montgomery, both of Ohio

[73] Assignee: The Procter & Gamble Company, Cincinnati, Ohio

[21] Appl. No.: 09/033,210

[22] Filed: Mar. 2, 1998

Related U.S. Application Data

[60] Provisional application No. 60/040,165, Mar. 11, 1997.

[51] Int. Cl.[7] ..... C11D 11/00

[52] U.S. Cl. ..... 510/444; 510/276; 510/348; 510/441

[58] Field of Search ..... 510/444, 441, 510/276

[56] References Cited

U.S. PATENT DOCUMENTS

| | | | |
|---|---|---|---|
| 3,932,316 | 1/1976 | Sagel et al. | 252/532 |
| 3,954,649 | 5/1976 | Lamberti | 252/174 |
| 3,957,695 | 5/1976 | Davies et al. | 252/532 |
| 3,979,314 | 9/1976 | Child | 510/348 |
| 3,981,686 | 9/1976 | Lobunez et al. | 23/302 |
| 3,992,314 | 11/1976 | Cherney | 252/160 |
| 3,997,692 | 12/1976 | Lamberti | 427/215 |
| 4,013,578 | 3/1977 | Child et al. | 510/348 |
| 4,022,702 | 5/1977 | Curtis | 510/348 |
| 4,035,257 | 7/1977 | Cherney | 510/531 |
| 4,040,988 | 8/1977 | Benson et al. | 252/532 |
| 4,049,586 | 9/1977 | Collier | 252/532 |
| 4,051,054 | 9/1977 | Davies et al. | 252/89 R |
| 4,076,653 | 2/1978 | Davies et al. | 252/532 |
| 4,162,994 | 7/1979 | Kowalchuk | 252/532 |
| 4,171,291 | 10/1979 | Malhotra et al. | 252/554 |
| 4,196,093 | 4/1980 | Clarke et al. | 510/317 |
| 4,348,293 | 9/1982 | Clarke et al. | 252/90 |
| 4,352,678 | 10/1982 | Jones et al. | 51/307 |
| 4,407,722 | 10/1983 | Davies et al. | 252/91 |
| 4,473,485 | 9/1984 | Greene | 252/174.12 |
| 4,711,740 | 12/1987 | Carter et al. | 252/174.24 |
| 4,828,620 | 5/1989 | Mallow et al. | 106/100 |
| 4,888,123 | 12/1989 | Price et al. | 510/348 |
| 4,900,466 | 2/1990 | Atkinson et al. | 252/174.14 |
| 4,908,159 | 3/1990 | Davies et al. | 510/444 |
| 4,966,606 | 10/1990 | Garner-Gray et al. | 252/174.14 |
| 5,219,541 | 6/1993 | Zolotoochin | 423/198 |
| 5,227,025 | 7/1993 | Kunesh et al. | 162/181.2 |
| 5,296,002 | 3/1994 | Passaretti | 23/304 |
| 5,554,587 | 9/1996 | Capeci | 510/444 |
| 5,658,867 | 8/1997 | Pancheri et al. | 510/108 |
| 5,691,297 | 11/1997 | Nassano et al. | 510/444 |
| 5,707,959 | 1/1998 | Pancheri et al. | 510/444 |
| 5,731,279 | 3/1998 | Pancheri | 510/340 |
| 5,733,865 | 3/1998 | Pancheri et al. | 510/531 |
| 5,853,686 | 12/1998 | Doxsee | 423/430 |

FOREIGN PATENT DOCUMENTS

| | | | |
|---|---|---|---|
| 0 518 576 A2 | 6/1992 | European Pat. Off. | C11D 3/10 |
| WO 93/22411 | 11/1993 | WIPO | C11D 3/10 |
| 97/02338 | 1/1997 | WIPO . | |
| 97/33966 | 9/1997 | WIPO . | |
| 98/40455 | 9/1998 | WIPO . | |
| 98/40456 | 9/1998 | WIPO . | |
| 98/40457 | 9/1998 | WIPO . | |
| 98/40458 | 9/1998 | WIPO . | |

OTHER PUBLICATIONS

Bjorklund, Robert B. & Arwin, Hans, "Absorption of anionic and catonic polymers on porous and non–porous calcium carbonate surfaces", Jun. 8, 1993, pp. 197–203.

Nancollas, G. H. & Reddy, M. M., "The Crystallization of Calcium Carbonate, II. Calcite Growth Mechanism[1]", Apr. 2, 1971, pp. 824–830.

Park, Nam–Seok, Kim, Myong–Won, Langford, S. C., & Dickinson, J. T., "Tribological Enhancement of $CaCo_3$ Dissolution during Scanning Force Microscopy", Jan. 16, 1996, pp. 4599–4604.

Wiezerbicki, A., Sikes, C. S. Madura, J. D. & Drake, B., "Atomic Force Microscopy and Molecular Modeling of Protein and Peptide Binding to Calcite", Aug. 19, 1993, pp. 133–141.

*Primary Examiner*—Lorna M. Douyon

*Attorney, Agent, or Firm*—D. Mitchell Goodrich; Kim William Zerby; Jacobus C. Rasser

[57] ABSTRACT

A process for preparing a detergent composition is provided. The process involves: (a) continuously mixing a detergent surfactant paste and dry starting detergent material into a high speed mixer/densifier to obtain detergent agglomerates, wherein the ratio of the surfactant paste to the dry detergent material is from about 1:10 to about 10:1; and (b) mixing the detergent agglomerates in a moderate speed mixer/densifier to further densify and agglomerate the detergent agglomerates. The dry detergent material contains a builder which is a selected crystalline calcium carbonate material substantially having a rhombohedral crystalline structure with {1,0,–1,1} crystallographic indices.

13 Claims, 4 Drawing Sheets

PROCESS FOR MAKING A GRANULAR DETERGENT COMPOSITION CONTAINING A SELECTED CRYSTALLINE CALCIUM CARBONATE BUILDER

CROSS REFERENCE TO RELATED APPLICATIONS

This application claims priority under Title 35, United States Code 119(e) from Provisional Application Ser. No. 60/040,165, filed Mar. 11, 1997.

FIELD OF THE INVENTION

The present invention generally relates to processes for producing a granular detergent composition. More particularly, the invention is directed to processes during which detergent granules or agglomerates are produced from starting detergent materials, one of which is a selected crystalline calcium carbonate builder. The builder is a selected crystalline calcium carbonate material substantially having a rhombohedral crystalline structure with {1,0,−1,1} crystallographic indices. The process produces a free flowing, granular detergent composition which can be commercially sold as a modern compact detergent product.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 600 g/l or higher. The low dosage detergents are currently in high demand as they conserve resources and can be sold in small packages which are more convenient for consumers. However, low density detergent products (e.g., less than 600 g/l) are still desired in many countries which do not prefer compact detergents.

Generally, there are two primary types of processes by which detergent granules or powders can be prepared. The first type of process involves spray-drying an aqueous detergent slurry in a spray-drying tower to produce highly porous detergent granules. In the second type of process, the various detergent components are dry mixed after which they are agglomerated with a binder such as a nonionic or anionic surfactant. In both processes, the most important factors which govern the density of the resulting detergent granules are the density, porosity and surface area of the various starting materials and their respective chemical composition.

There has been interest in the art for providing processes which increase the density of detergent granules or powders. Particular attention has been given to densification of spray-dried granules by post tower treatment. For example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. More recently, other processes have developed for increasing the density of "post-tower" or spray dried detergent granules. Typically, such processes require a first apparatus which pulverizes or grinds the granules and a second apparatus which increases the density of the pulverized granules by agglomeration. These processes achieve the desired increase in density by treating or densifying "post tower" or spray dried granules. The art is also replete with disclosures of processes which entail agglomerating detergent compositions. For example, attempts have been made to agglomerate detergent builders by mixing zeolite and/or layered silicates in a mixer to form free flowing agglomerates.

Furthermore, it has been long-established practice for detergent formulators to use builder materials and combinations thereof in detergent compositions. By way of example, certain clay minerals have been used to adsorb hardness cations, especially in fabric laundering operations. Further, the zeolites (or aluminosilicates) have been suggested for use in various cleaning situations as detergency builders. For example, water-insoluble aluminosilicate ion exchange materials have been widely used in detergent compositions throughout the industry. While such builder materials are quite effective and useful, they account for a significant portion of the cost in most any fully formulated detergent composition. Therefore, it would be desirable to have a builder material which performs as well as or better than the aforementioned builders, and importantly, is also less expensive.

Accordingly, there remains a need in the art for a process which produces a granular and/or agglomerated detergent composition from starting detergent ingredients including an improved builder material which can improve the flow properties and the cleaning performance of the composition. Also, there remains a need for such a process which is more efficient and economical to facilitate large-scale production of low dosage or compact detergents.

BACKGROUND ART

The following references are directed to densifying spray-dried granules: Appel et al, U.S. Pat. No. 5,133,924 (Lever); Bortolotti et al, U.S. Pat. No. 5,160,657 (Lever); Johnson et al, British patent No. 1,517,713 (Unilever); and Curtis, European Patent Application 451,894. The following references are directed to producing detergents by agglomeration: Beerse et al, U.S. Pat. No. 5,108,646 (Procter & Gamble); Hollingsworth et al, European Patent Application 351,937 (Unilever); Swatling et al, U.S. Pat. No. 5,205,958; and Capeci et al, U.S. Pat. Nos. 5,366,652, 5,486,303, 5,489,392, 5,554,587 and 5,516,448 (all assigned to Procter & Gamble).

The following references are directed to builders for various detergent compositions: Atkinson et al, U.S. Pat. No. 4,900,466 (Lever); Houghton, WO 93/22411 (Lever); Allan et al, EP 518 576 A2; (Lever); Zolotoochin, U.S. Pat. No. 5,219,541 (Tenneco Minerals Company); Garner-Gray et al, U.S. Pat. No. 4,966,606 (Lever); Davies et al, U.S. Pat. No. 4,908,159 (Lever); Carter et al, U.S. Pat. No. 4,711,740 (Lever); Greene, U.S. Pat. No. 4,473,485 (Lever); Davies et al, U.S. Pat. No. 4,407,722 (Lever); Jones et al, U.S. Pat. No. 4,352,678 (Lever); Clarke et al, U.S. Pat. No. 4,348,293 (Lever); Clarke et al, U.S. Pat. No. 4,196,093 (Lever); Benjamin et al, U.S. Pat. No. 4,171,291 (Procter & Gamble); Kowalchuk, U.S. Pat. No. 4,162,994 (Lever); Davies et al, U.S. Pat. No. 4,076,653 (Lever); Davies et al, U.S. Pat. No. 4,051,054 (Lever); Collier, U.S. Pat. No. 4,049,586 (Procter & Gamble); Benson et al, U.S. Pat. No. 4,040,988 (Procter & Gamble); Cherney, U.S. Pat. No. 4,035,257 (Procter & Gamble); Curtis, U.S. Pat. No. 4,022,702 (Lever); Child et al, U.S. Pat. No. 4,013,578 (Lever); Lamberti, U.S. Pat. No.

3,997,692 (Lever); Cherney, U.S. Pat. No. 3,992,314 (Procter & Gamble); Child, U.S. Pat. No. 3,979,314 (Lever); Davies et al, U.S. Pat. No. 3,957,695 (Lever); Lamberti, U.S. Pat. No. 3,954,649 (Lever); Sagel et al U.S. Pat. No. 3,932,316 (Procter & Gamble); Lobunez et al, U.S. Pat. No. 3,981,686 (Intermountain Research and Development Corp.); Mallow et al, U.S. Pat. No. 4,828,620 (Southwest Research Institute); Bjorklund et al, "Adsorption of Anionic and Cationic Polymers on Porous and Non-porous Calcium Carbonate Surfaces," *Applied Surface Science* 75 pp. 197–203 (1994); Wierzbicki et al, "Atomic Force Microscopy and Molecular Modeling of Protein and Peptide Binding to Calcite," *Calcified Tissue International* 54, pp. 133–141 (1994); Park et al, "Tribological Enhancement of $CaCO_3$ Dissolution during Scanning Force Microscopy," *Langmuir,* pp. 4599–4603, 12 (1996); and Nancollas et al, "The Crystallization of Calcium Carbonate," *Journal of Colloid and Interface Science,* Vol. 37, No. 4, pp. 824–829 (Dec. 1971).

SUMMARY OF THE INVENTION

The present invention meets the aforementioned needs in the art by providing a process which produces a granular and/or agglomerated detergent composition directly from an improved builder material and other starting detergent ingredients. The builder is a selected crystalline calcium carbonate material substantially having a rhombohedral crystalline structure with {1,0,−1,1} crystallographic indices, the most common form of which is referred to as calcite having such a crystal configuration. This builder can also serve as a coating agent to improve the flow properties of the detergent composition. As a consequence of the process, the detergent composition also exhibits improved performance and is less expensive.

In accordance with one aspect of the invention, a process for preparing a crisp, free flowing, detergent composition is provided. The process comprises the steps of: (a) continuously mixing a detergent surfactant paste and dry starting detergent material into a high speed mixer/densifier to obtain detergent agglomerates, wherein the ratio of the surfactant paste to the dry detergent material is from about 1:10 to about 10:1 and the dry detergent material contains a builder is a crystalline calcium carbonate material substantially having a rhombohedral crystalline structure with {1,0,−1,1} crystallographic indices; (b) mixing the detergent agglomerates in a moderate speed mixer/densifier to further densify and agglomerate the detergent agglomerates; and (c) optionally, drying the detergent agglomerates so as to form the high density detergent composition.

One preferred embodiment entails processing the agglomerates such that the density of the detergent composition is at least 650 g/l. In another preferred embodiment, the process further comprises the step of adding a coating agent in and/or after the moderate speed mixer/densifier, wherein the coating agent is selected from the group consisting of aluminosilicates, carbonates, silicates, the instant crystalline builder material and mixtures thereof.

Other embodiments include maintaining the mean residence time of the detergent agglomerates in the high speed mixer/densifier in range from about 2 seconds to about 45 seconds; and/or maintaining the mean residence time of the detergent agglomerates in the moderate speed mixer/densifier in range from about 0.5 minutes to about 15 minutes.

In still other aspects of the invention, the ratio of the surfactant paste to the dry detergent material is from about 1:4 to about 4:1. The surfactant paste has a viscosity of from about 1,000 cps to about 100,000 cps, wherein the surfactant paste comprises a surfactant selected from the group consisting of anionic, nonionic, zwitterionic, ampholytic and cationic surfactants and mixtures thereof. Other embodiments of the invention are directed to a step of adding a coating agent in the moderate speed mixer/densifier, and/or a step of adding a coating agent between the mixing step and the drying step.

In an especially preferred embodiment of the invention, the process comprises the steps of: (a) continuously mixing a detergent surfactant paste and a dry starting detergent material into a high speed mixer/densifier to obtain detergent agglomerates, wherein the ratio of the surfactant paste to dry detergent material is from about 1:10 to about 10:1; (b) mixing the detergent agglomerates in a moderate speed mixer/densifier to further densify and agglomerate the detergent agglomerates; (c) drying the detergent agglomerates; and (d) adding a coating agent to the detergent agglomerates so as to obtain said high density detergent composition having a density of at least 650 g/l; wherein the coating agent is a crystalline calcium carbonate material substantially having a rhombohedral crystalline structure with {1,0,−1,1} crystallographic indices. The invention also provides a high density detergent composition made according to the process of the invention and its various embodiments.

In another aspect of the invention, a process involving spray drying detergent ingredients to provide a detergent composition is provided. More particularly, the process comprises the step of spray drying an aqueous slurry containing a surfactant and a builder which is a crystalline calcium carbonate substantially having a rhombohedral crystalline structure with {1,0,−1,1} crystallographic indices and a detergent surfactant to form spray dried granules. Optionally, this process can include the steps of: (a) continuously mixing a detergent surfactant paste and dry starting detergent material into a high speed mixer/densifier to obtain detergent agglomerates, wherein the ratio of the surfactant paste to the dry detergent material is from about 1:10 to about 10:1; (b) mixing the detergent agglomerates in a moderate speed mixer/densifier to further densify and agglomerate the detergent agglomerates; and (c) blending the granules and the detergent agglomerates together so as to form a high density detergent composition.

In yet another embodiment of the invention, another process for continuously preparing a detergent composition is provided. This process comprises the steps of: (a) continuously mixing an acid precursor of a detergent surfactant and dry starting detergent material into a high speed mixer/densifier to obtain detergent agglomerates, wherein the dry detergent material includes crystalline calcium carbonate substantially having a rhombohedral crystalline structure with {1,0,−1,1} crystallographic indices and sodium carbonate such that the sodium carbonate neutralizes the acid precursor; and (b) mixing the detergent agglomerates in a moderate speed mixer/densifier to further densify and agglomerate the detergent agglomerates.

Accordingly, it is an object of the present invention to provide a process for producing a granular and/or agglomerated detergent composition directly from starting detergent ingredients which includes an improved detergency builder. It is also an object of the invention to provide such a process which is not limited by unnecessary process parameters so that large-scale production of low dosage or compact detergents is more economical and efficient. These and other objects, features and attendant advantages of the present invention will become apparent to those skilled in the art from a reading of the following drawing, detailed description of the preferred embodiment and the appended claims.

All percentages and ratios used herein are expressed as percentages by weight (anhydrous basis) unless otherwise indicated. All documents are incorporated herein by reference. All viscosities referenced herein are measured at 70° C. (±5° C.) and at shear rates of about 10 to 100 $sec^{-1}$.

BRIEF DESCRIPTION OF THE DRAWINGS

(FIG. 9 is a partial perspective depicting only the top portion of the crystal), all of which are outside the scope of the invention.

DETAILED DESCRIPTION OF THE PREFERRED EMBODIMENT

Figure 1:
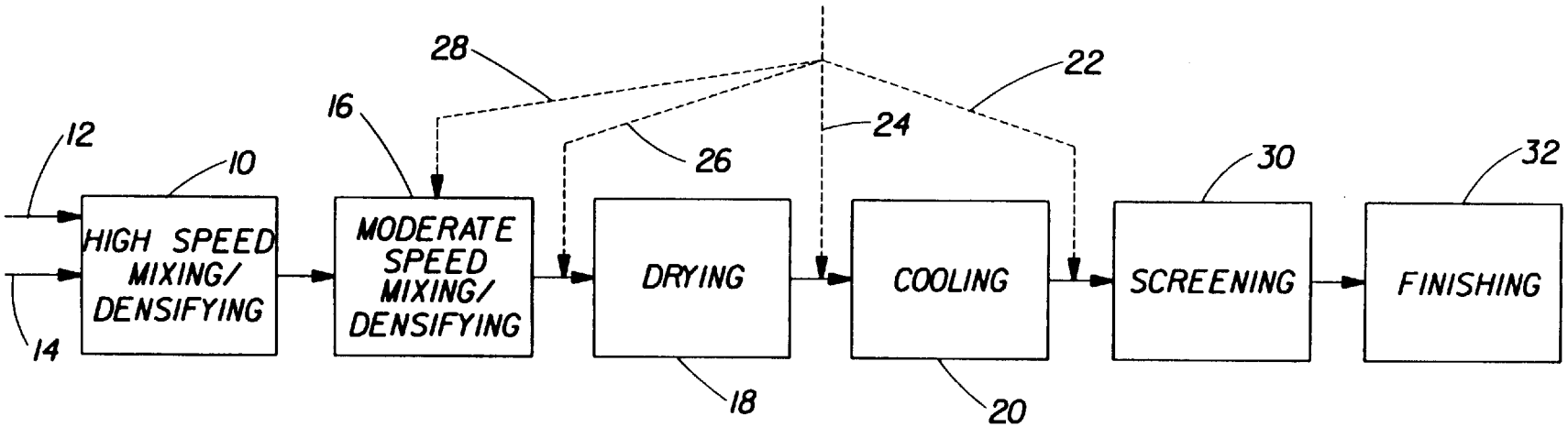
FIG. 1 is a flow chart illustrating a preferred process in which two agglomerating mixer/densifiers, fluid bed dryer, fluid bed cooler and screening apparatus are serially positioned in accordance with the invention.

The present process is used in the production of detergent compositions by way of agglomeration of starting detergent ingredients or by way of spray drying techniques which can include further processing of the "post-tower" detergent granules. By "post-tower" detergent granules, we mean those detergent granules which have been processed through a conventional spray-drying tower or similar apparatus. As used herein, the term "agglomerates" refers to particles formed by build-up agglomeration of starting detergent ingredients (particles) which typically have a smaller median particle size than the formed agglomerates. As used herein, the phrase "effective amount" means that the level of the builder material in the composition is sufficient to sequester an adequate amount of hardness in the washing solution such that the detersive surfactant is not overly inhibited. As used herein, the word "crystalline" means a mixture or material having a regularly repeating internal arrangement (i.e., "lattice") of its atoms and external plane faces. As used herein, the phrase "substantially having a rhombohedral crystalline structure" means a crystal having the form of a parallelogram and no right angles (e.g., as depicted in FIG. 1). As used herein, "{1,0,−1,1} crystallographic indices" refers to a specific set of crystal planes on a hexagonal coordinate system which defines a selected crystalline structure (also referenced as the "Miller indices" for a hexagonal coordinate system). As used herein, the phrase "crystalline calcium carbonate" refers to the chemical entity, calcium carbonate, in crystalline form, of which the most common form is referenced as "calcite". Also see standard texts on all of these subjects, such as Blackburn et al, *Principles of Mineralogy,* 2nd Ed., pp. 21–51 (1994) and Klein et al, *Manual of Mineralogy,* p. 405 et seq (1977). As used herein, "mean residence time" is measured via dividing the throughput through the mixer by the weight of the mixer as measured by standard load cells which are typically part of commercially available mixers.

Agglomeration Process

Reference is now made to FIG. 1 which presents a flow chart illustrating the agglomeration process and various embodiments thereof. In the first step of the process, the invention entails continuously mixing into a high speed mixer/densifier 10 several streams of starting detergent ingredients including a surfactant paste stream 12 and a dry starting detergent material stream 14. The surfactant paste 12 preferably comprises from about 15% to about 65%, preferably from about 25% to about 55% and, most preferably from about 33% to about 44%, of a detergent surfactant in an aqueous paste form. Preferably, the dry starting detergent material 14 comprises from about 20% to about 90%, preferably from about 25% to about 70% and, most preferably from about 30% to about 60% of an aluminosilicate or zeolite builder, the instant crystalline calcium carbonate builder and mixtures thereof and from about 0% to about 70%, preferably from about 15% to about 50% and, most preferably from about 15% to about 35% of a sodium carbonate. It should be understood that additional starting detergent ingredients several of which are described hereinafter may be mixed into high speed mixer/densifier 10 without departing from the scope of the invention.

However, it has surprisingly been found that the surfactant paste 12 and the dry starting detergent material 14 are continuously mixed within the ratio ranges described herein so as to insure production of the desired free flowing, crisp, high density detergent composition. Preferably, the ratio of the surfactant paste 12 to the dry starting detergent material 14 is from about 1:10 to about 10:1, more preferably from about 1:4 to about 4:1 and, most preferably from about 3:1 to about 1:3.

It has been found that the first processing step can be successfully completed, under the process parameters described herein, in a high speed mixer/densifier 10 which preferably is a Lödige CB mixer or similar brand mixer. These types of mixers essentially consist of a horizontal, hollow static cylinder having a centrally mounted rotating shaft around which several plough-shaped blades are attached. Preferably, the shaft rotates at a speed of from about 300 rpm to about 2500 rpm, more preferably from about 400 rpm to about 1600 rpm. Preferably, the mean residence time of the detergent ingredients in the high speed mixer/densifier 10 is preferably in range from about 2 seconds to about 45 seconds, and most preferably from about 5 seconds to about 15 seconds.

The resulting detergent agglomerates formed in the high speed mixer/densifier 10 are then fed into a lower or moderate speed mixer/densifier 16 during which further agglomeration and densification is carried forth. This particular moderate speed mixer/densifier 16 used in the present process should include liquid distribution and agglomeration tools so that both techniques can be carried forth simultaneously. It is preferable to have the moderate speed mixer/densifier 16 to be, for example, a Lödige KM (Ploughshare) mixer, Drais® K-T 160 mixer or similar brand mixer. The main centrally rotating shaft speed is from about 30 to about 160 rpm, more preferably from about 50 to about 100 rpm. The mean residence time in the moderate speed mixer/densifier 16 is preferably from about 0.5 minutes to about 15 minutes, most preferably the mean residence time is about 1 to about 10 minutes. The liquid distribution is accomplished by cutters, generally smaller in size than the rotating shaft, which preferably operate at about 3600 rpm.

In accordance with the present process, the high speed mixer/densifier 10 and moderate speed mixer/densifier 16 in combination preferably impart a requisite amount of energy to form the desired agglomerates. More particularly, the instant process imparts from about $5\times10^{9}$ erg/kg to about $2\times10^{13}$ erg/kg at a rate of from about $3\times10^{7}$ erg/kg-sec to about $3\times10^{10}$ erg/kg-sec to form free flowing detergent agglomerates. The energy input and rate of input can be determined by calculations from power readings to the moderate speed mixer/densifier with and without granules, residence time of the granules in the mixer/densifier, and the mass of the granules in the mixer/densifier. Such calculations are clearly within the scope of the skilled artisan.

The density of the resulting detergent agglomerates exiting the moderate speed mixer/densifier 16 is at least 650 g/l, more preferably from about 700 g/l to about 800 g/l. Thereafter, the detergent agglomerates are optionally dried in a fluid bed dryer 18 or similar apparatus to obtain the granular detergent composition which is ready for packaging and sale as a detergent product at this point. The particle porosity of the resulting detergent agglomerates of the composition is preferably in a range from about 5% to about 20%, more preferably at about 10%. In addition, an attribute of dense or densified detergent agglomerates is the relative particle size. To that end, the present process typically provides agglomerates having a median particle size of from about 400 microns to about 700 microns, and more preferably from about 450 microns to about 500 microns. As used herein, the phrase "median particle size" refers to individual agglomerates and not individual particles or detergent granules and refers to the value at which 50% of the particles have a larger size while 50% of the particles have a smaller size. The combination of the above-referenced porosity and particle size results in agglomerates having density values of 650 g/l and higher. Such a feature is especially useful in the production of low dosage laundry detergents as well as other granular compositions such as dishwashing compositions.

Optional Process Steps

In an optional step of the present process, the detergent agglomerates exiting the fluid bed dryer 18 can be further conditioned by cooling the agglomerates in a fluid bed cooler 20 or similar apparatus as are well known in the art. Another optional process step involves adding a coating agent to improve flowability and/or minimize over agglomeration of the detergent composition in one or more of the following locations of the instant process: (1) the coating agent can be added directly after the fluid bed cooler 20 as shown by coating agent stream 22 (preferred); (2) the coating agent may be added between the fluid bed dryer 18 and the fluid bed cooler 20 as shown by coating agent stream 24; (3) the coating agent may be added between the fluid bed dryer 18 and the moderate speed mixer/densifier 16 as shown by stream 26; and/or (4) the coating agent may be added directly to the moderate speed mixer/densifier 16 and the fluid bed dryer 18 as shown by stream 28. It should be understood that the coating agent can be added in any one or a combination of streams 22, 24, 26, and 28 as shown in FIG. 1. The coating agent stream 22 is the most preferred in the instant process.

The coating agent is preferably selected from the group consisting of aluminosilicates, silicates, carbonates and mixtures thereof. The coating agent can also be the crystalline calcium carbonate builder material described in more detail hereinafter. However, the coating agent may be one or more combinations of the crystalline calcium builder, aluminosilicates, carbonates, silicates and the like. The coating agent not only enhances the free flowability of the resulting detergent composition which is desirable by consumers in that it permits easy scooping of detergent during use, but also serves to control agglomeration by preventing or minimizing over agglomeration, especially when added directly to the moderate speed mixer/densifier 16. As those skilled in the art are well aware, over agglomeration can lead to very undesirable flow properties and aesthetics of the final detergent product.

Optionally, the process comprises the step of spraying an additional binder in one or both of the mixer/densifiers 10 and 16. A binder is added for purposes of enhancing agglomeration by providing a "binding" or "sticking" agent for the detergent components. The binder is preferably selected from the group consisting of water, anionic surfactants, nonionic surfactants, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Other optional steps contemplated by the present process include screening the oversized detergent agglomerates in a screening apparatus 30 which can take a variety of forms including but not limited to conventional screens chosen for the desired particle size of the finished detergent product. Other optional steps include conditioning of the detergent agglomerates by subjecting the agglomerates to additional drying. The various operating parameters involved in such optional steps are discussed in U.S. Pat. Nos. 5,366,652, 5,486,303, 5,489,392, 5,554,587 and 5,516,448, all of which are issued to Capeci et al and are incorporated herein by reference.

Another optional step of the instant process entails finishing the resulting detergent agglomerates by a variety of processes including spraying and/or admixing other conventional detergent ingredients, collectively referenced as the finishing step 32 in FIG. 1. For example, the finishing step encompasses spraying perfumes, brighteners and enzymes onto the finished agglomerates to provide a more complete detergent composition. Such techniques and ingredients are well known in the art.

Spray Drying Process

One or more spray drying techniques can be used alone, or in combination with the aforementioned agglomeration processes, to make detergent compositions in accordance with the instant invention. One or more spray-drying towers may be employed to manufacture granular laundry detergents which often have a density of about 600 g/l or less. In this procedure, an aqueous slurry of various heat-stable ingredients in the final detergent composition are formed into homogeneous granules by passage through a spray-drying tower, using conventional techniques, at temperatures of about 175° C. to about 375° C. If spray drying is used as part of the overall process herein, additional process steps as described herein can be optionally used to obtain the level of density (i.e., >650 g/l) required by modern compact, low dosage detergent products.

For example, spray-dried granules from a tower can be densified further by loading a liquid such as water or a nonionic surfactant into the pores of the granules and/or subjecting them to one or more high speed mixer/densifiers. A suitable high speed mixer/densifier for this process is the aforementioned "Lödige CB 30" or "Lödige CB 30 Recycler" which comprises a static cylindrical mixing drum having a central rotating shaft with mixing/cutting blades mounted thereon. In use, the ingredients for the detergent composition are introduced into the drum and the shaft/blade assembly is rotated at speeds in the range of 100–2500 rpm to provide thorough mixing/densification. See Jacobs et al, U.S. Pat. No. 5,149,455, issued Sep. 22, 1992 and Del Greco et al, U.S. Pat. No. 5,565,422, issued Oct. 15, 1996. Other such apparatus includes the devices marketed under the trade name "Shugi Granulator" and under the trade name "Drais K-TTP 80").

Another process step which can be used to densify further spray-dried granules involves grinding and/or agglomerating the spray-dried granules in a moderate speed mixer/densifier so as to obtain particles having lower porosity. Equipment such as the aforementioned "Lödige KM" (Series 300 or 600) or "Lödige Ploughshare" mixer/densifiers are suitable for this process step. Other useful equipment includes the device which is available under the trade name "Drais K-T 160". This process step which employs a moderate speed mixer/densifier (e.g. Lödige KM) can be used by itself or sequentially with the aforementioned high speed mixer/densifier (e.g. Lödige CB) to achieve the desired density. Other types of granules manufacturing apparatus useful herein include the apparatus disclosed in U.S. Pat. No. 2,306,898, to G. L. Heller, Dec. 29, 1942.

While it may be more suitable to use the high speed mixer/densifier followed by the low speed mixer/densifier, the reverse sequential mixer/densifier configuration is also contemplated by the invention. One or a combination of various parameters including residence times in the mixer/densifiers, operating temperatures of the equipment, temperature and/or composition of the granules, the use of adjunct ingredients such as liquid binders and flow aids, can be used to optimize densification of the spray-dried granules in the process of the invention. By way of example, see the processes in Appel et al, U.S. Pat. No. 5,133,924, issued Jul. 28, 1992 (spray-dried granules are densified); Delwel et al, U.S. Pat. No. 4,637,891, issued Jan. 20, 1987 (granulating spray-dried granules with a liquid binder and aluminosilicate); Kruse et al, U.S. Pat. No. 4,726,908, issued Feb. 23, 1988 (granulating spray-dried granules with a liquid binder and aluminosilicate); and, Bortolotti et al, U.S. Pat. No. 5,160,657, issued Nov. 3, 1992 (coating densified granules with a liquid binder and aluminosilicate).

Admixing Process

Specifically, other aspects of the process invention include admixing the builder material with spray dried granules, agglomerates or combinations thereof. This admixing step may be enhanced by combining the granules, agglomerates, or combinations thereof with the crystalline calcium carbonate builder and a liquid binder as described previously in a mixing drum or other similar device. Optionally, the builder material may be coated with a nonionic surfactant or other liquid binder as described previously before the admixing step so as to preclude any deleterious interaction with the other detergent ingredients (e.g. anionic surfactants) prior to immersion in the washing solution (i.e. during processing and storage). This liquid binder (e.g. nonionic surfactant) coating also improves the flow properties of the detergent composition in which the builder material is included.

Other Processes

In yet another process embodiment, the high density detergent composition can be produced using a fluidized bed mixer. In this process, the various ingredients of the finished composition are combined in an aqueous slurry (typically 80% solids content) and sprayed into a fluidized bed to provide the finished detergent granules. Prior to the fluidized bed, this process can optionally include the step of mixing the slurry using the aforementioned Lödige CB mixer/densifier and/or a "Flexomix 160" mixer/densifier, available from Shugi. Fluidized bed or moving beds of the type available under the trade name "Escher Wyss" can be used in such processes.

Another suitable process which can be used herein involves feeding a liquid acid precursor of an anionic surfactant, an alkaline inorganic material (e.g. sodium carbonate) and optionally other detergent ingredients into a high speed mixer/densifier (mean residence time 5–30 seconds) so as to form agglomerates containing a partially or totally neutralized anionic surfactant salt and the other starting detergent ingredients. Optionally, the contents in the high speed mixer/densifier can be sent to a moderate speed mixer/densifier (e.g. Lödige KM) for further agglomeration resulting in the finished high density detergent composition. See Appel et al, U.S. Pat. No. 5,164,108, issued Nov. 17, 1992, which discloses a neutralization process but does not incorporate the crystalline calcium carbonate material described herein.

Optionally, high density detergent compositions can be produced by blending conventional or densified spray-dried detergent granules with detergent agglomerates in various proportions (e.g. a 60:40 weight ratio of granules to agglomerates) produced by one or a combination of the processes discussed herein. Additional adjunct ingredients such as enzymes, perfumes, brighteners and the like can be sprayed or admixed with the agglomerates, granules or mixtures thereof produced by the processes discussed herein.

Crystalline Calcium Carbonate Builder

Figure 2:
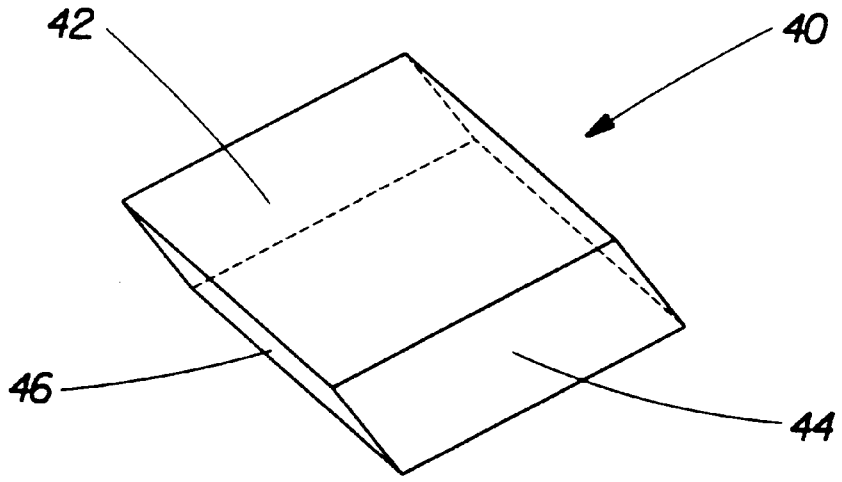
FIG. 2 illustrates a crystalline calcium carbonate structure in accordance with the invention.

The crystalline calcium carbonate used in the processes of the present invention has a substantially rhombohedral crystalline structure 40 as depicted in FIG. 2. This crystalline calcium carbonate is defined by {1,0,−1,1} crystallographic or Miller indices. It has been surprisingly found that by judiciously selecting a crystalline calcium carbonate of such a crystalline configuration, superior builder performance (i.e., removal of water hardness) can be achieved when used in typical detergent compositions for laundering soiled clothes. The median particle size of this crystalline calcium carbonate as detailed hereinafter is not required to be in the very small range (e.g., less than about 2 microns with a surface areas at least about 15 $m^2/g$).

While not intending to be bound by theory, it is believed that the outer surfaces, e.g., 42, 44 and 46 depicted in FIG. 2, have a significantly high population of oxygen atoms which lends the entire crystalline structure to have more of an affinity to calcium cations which is the predominant source of water hardness. Those skilled in the art will appreciate that this is a crystal having {1,0,−1,1} crystallographic indices and its crystal faces are defined thereby. By contrast, FIGS. 3–9 define crystal structures of crystalline calcium carbonate or calcite which do not substantially have a rhombohedral crystalline structure with {1,0,−1,1} crystallographic indices. Moreover, all of the crystal faces or cleavage planes of the calcite crystal structures depicted in FIGS. 3–9 can have a much higher population of calcium atoms, thereby creating a strong positive charge on the outer surfaces of these crystals. This, as those skilled in the art will appreciate, does cause these crystalline structures to be less effective at sequestering water hardness cations.

Figure 3:
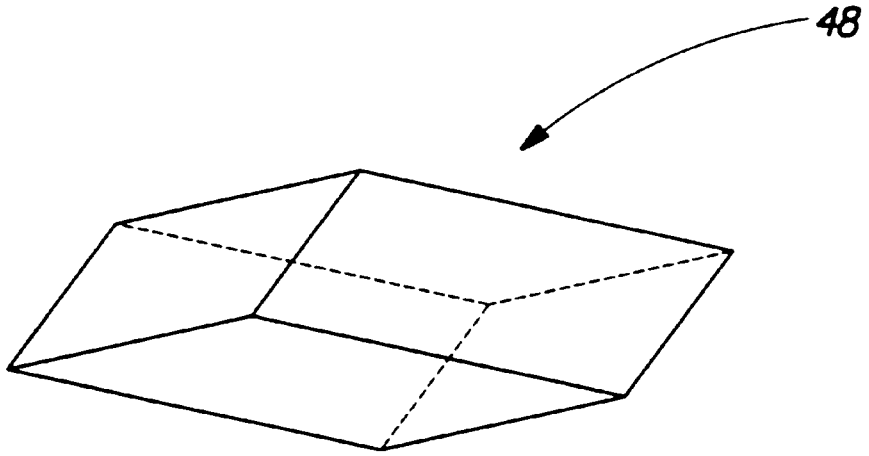
FIGS. 3–9 illustrate naturally occurring crystalline calcium carbonate structures that are commonly found in nature
Figure 4:
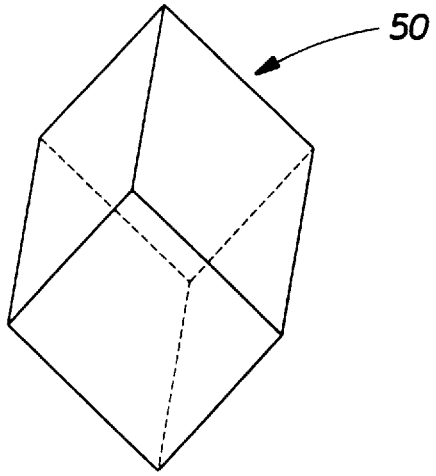
Figure 5:
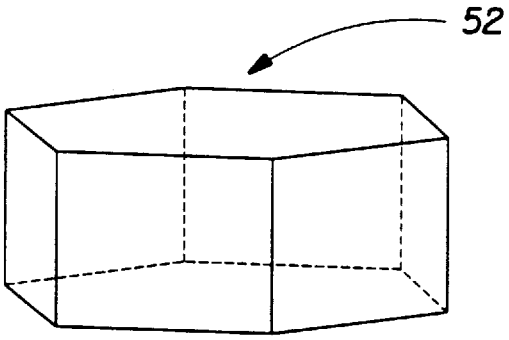
Figure 6:
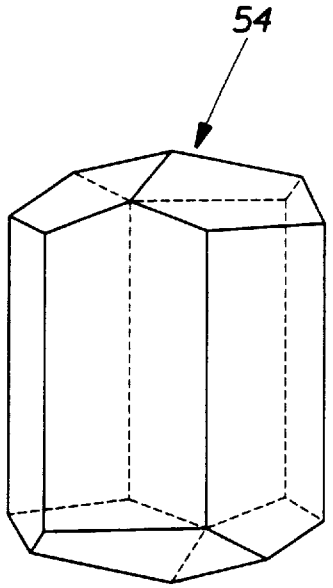
Figure 7:
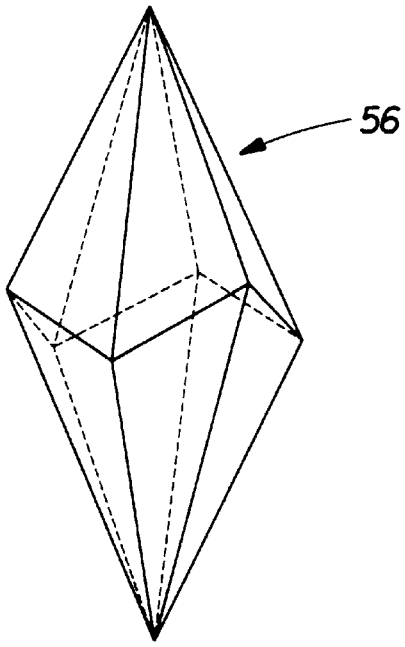
Figure 8:
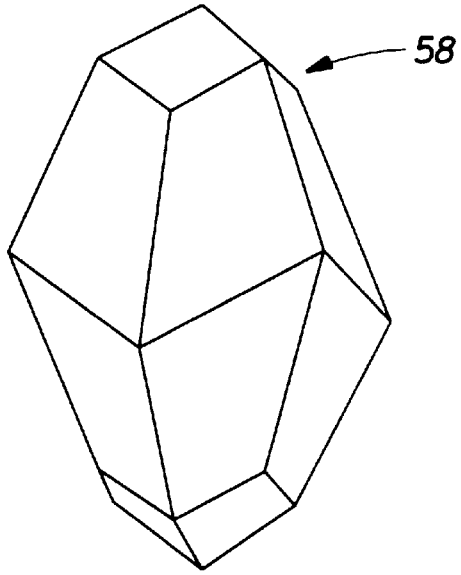
Figure 9:
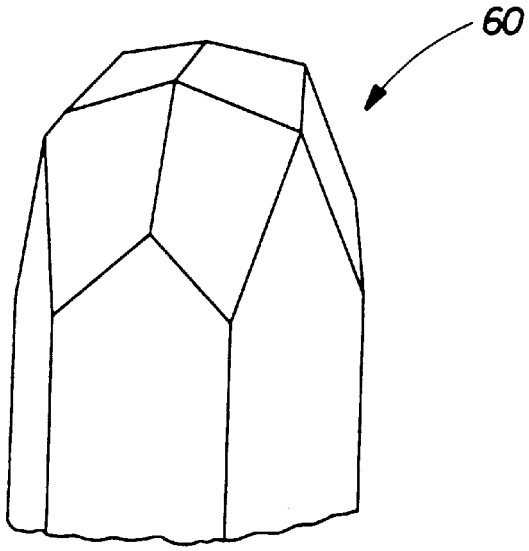

Specifically, FIG. 3 depicts a crystalline calcium carbonate having a rhombohedral structure 48, but with {0,1,−1,2} crystallographic indices. FIG. 4 illustrates crystalline calcium carbonate or calcite in a cubic crystal structure 50 having {0,2,−2,1} crystallographic indices. FIG. 5 depicts a hexagonal crystal structure 52 with {1,0,−1,0} and {0,0,0,1} crystallographic indices, while FIG. 6 shows a prismatic structure 54 with {1,0,−1,0} and {0,1,−1,2} crystallographic indices. FIG. 7 depicts a crystalline calcium carbonate structure 56 having {2,1,−3,1} crystallographic indices, and FIG. 8 illustrates a scalenohedral calcite crystal structure 58 with {2,1,−3,1} and small faces with the preferred {1,0,−1,1} crystallographic indices. Lastly, FIG. 9 illustrates a top partial perspective view of yet another calcium carbonate crystalline structure 60 which has {0,1,−1,2}, {2,1,−3,1} and {1,0,×1,0} crystallographic indices.

FIGS. 4, 5, 6 and 8 depict the most common calcite crystals found in nature. It should be understood that none of these calcite crystal structures are in the form of FIG. 2 which is within the scope of the invention. Furthermore, it is believed that the calcite crystal structures of FIGS. 3–9 do not perform as well as the FIG. 2 structure because the FIGS. 3–9 structures have a high population of calcium atoms at their respective crystal planes (i.e., outer surfaces), thereby resulting in poor performance relative to water hardness cation sequestration. To the contrary, as mentioned previously, the calcite crystal depicted in FIG. 2 has a high population of oxygen atoms and low population of calcium atoms on its respective cleavage planes (i.e., {1,0,−1,1} crystallographic indices) rendering it a particularly effective seed crystal for water hardness cation (e.g., calcium cations) sequestration. This results in a superior performing detergent composition as the deleterious effects of water hardness on surfactant performance is eliminated or severely inhibited.

The "crystalline" nature of the builder material can be detected by X-ray Diffraction techniques known by those skilled in the art. X-ray diffraction patterns are commonly collected using Cu $K_{alpha}$ radiation on an automated powder diffractometer with a nickel filter and a scintillation counter to quantify the diffracted X-ray intensity. The X-ray diffraction diagrams are typically recorded as a pattern of lattice spacings and relative X-ray intensities. In the Powder Diffraction File database by the Joint Committee on Powder Diffraction Standards—International Centre for Diffraction Data, X-ray diffraction diagrams of corresponding preferred builder materials include, but are not limited to, the following numbers: 5-0586 and 17-0763.

The actual amount of crystalline calcium carbonate builder used in the processes described herein will vary widely depending upon the particular application. However, typical amounts are from about 0.1% to about 80%, more typically from about 4% to about 60%, and most typically from about 6% to about 40%, by weight of the detergent composition produced by the process. The median particle size of the builder is preferably from about 0.2 microns to about 20 microns, more preferably from about 0.3 microns to about 15 microns, even more preferably from about 0.4 microns to about 10 microns, and most preferably from about 0.5 microns to about 10 microns. While the crystalline calcium carbonate builder used in the detergent composition herein performs at any median particle size, it has been found that optimum overall performance can be achieved within the aforementioned median particle size ranges.

The phrase "median particle size" as used herein means the particle size as measured by the particle's diameter of a given builder in which 50% by weight of the population has a higher particle size and 50% has a lower particle size. The median particle size is measured at its usage concentration in water (after 10 minutes of exposure to this water solution at a temperature of 50 F to 130 F) as determined by conventional analytical techniques such as, for example, microscopic determination using a scanning electron microscope (SEM), Coulter Counter or Malvern particle size instruments. In general, the particle size of the builder not at its usage concentration in water can be any convenient size.

In addition to the median particle size or in the alternative to it, the crystalline calcium carbonate builder preferably has selected surface area for optimal performance. More specifically, the crystalline calcium carbonate has a surface area of from about 0.01 $m^2/g$ to about 12 $m^2/g$, more preferably from about 0.1 $m^2/g$ to about 10 $m^2/g$, even more preferably from about 0.2 $m^2/g$ to about 5 $m^2/g$, and most preferably from about 0.2 $m^2/g$ to about 4 $m^2/g$. Other suitable surface area ranges include from about 0.1 $m^2/g$ to about 4 $m^2/g$ and from about 0.01 $m^2/g$ to about 4 $m^2/g$. The surface areas can be measured by standard techniques including by nitrogen adsorption using the standard Bruauer, Emmet & Teller (BET) method. A suitable machine for this method is a Carlo Erba Sorpty 1750 instrument operated according to the manufacturer's instructions.

The crystalline calcium carbonate builder used in the processes herein also unexpectedly has improved builder performance in that it has a high calcium ion exchange capacity. In that regard, the builder material has a calcium ion exchange capacity, on an anhydrous basis, of at least about 100 mg equivalent of calcium carbonate hardness/gram, more preferably at least about 200 mg, and even more preferably at least about 300 mg, and most preferably from at least about 400 mg, equivalent of calcium carbonate hardness per gram of builder. Additionally, the builder unexpectedly has an improved calcium ion exchange rate. On an anhydrous basis, the builder material has a calcium carbonate hardness exchange rate of at least about 5 ppm, more preferably from about 10 ppm to about 150 ppm, and most preferably from about 20 ppm to about 100 ppm, $CaCO_3$/minute per 200 ppm of the builder material. A wide variety of test methods can be used to measure the aforementioned properties including the procedure exemplified hereinafter and the procedure disclosed in Corkill et al, U.S. Pat. No. 4,605,509 (issued Aug. 12, 1986), the disclosure of which is incorporated herein by reference.

In a preferred embodiment of the invention, the detergent composition produced by the process invention is substantially free of phosphates and phosphonates. As used herein, "substantially free" means has less than 0.05% by weight of a given material. Alternatively, or in addition to the foregoing phosphate limitation, the detergent composition is substantially free of soluble silicates, especially if magnesium cations are part of the water hardness composition in the particular use and the detergent composition does not include an auxiliary builder to sequester such cations. In this regard, superior performance of the detergent composition containing the aforedescribed builder can be achieved if the detergent composition is substantially free of polycarboxylates, polycarboxylic oligomer/polymers and the like. It has also been found that optimal performance can be achieved using such materials in the detergent composition so long as the polycarboxylate is pre-blended with the surfactant before exposure to the crystalline calcium carbonate, either during manufacture of the detergent composition or during use.

In another preferred aspect of the invention, the detergent composition produced by the process is substantially free of potassium salts, or if they are present, are included at very low levels. Specifically, the potassium salts are included at levels of about 0.01% to about 5%, preferably at about 0.01% to about 2% by weight of the detergent composition.

Preferably, if sodium sulfate and sodium carbonate are included in the detergent composition, they are preferably in a weight ratio of about 1:50 to about 2:1, more preferably from about 1:40 to about 1:1, most preferably from about 1:20 to about 1:1 of sodium sulfate to sodium carbonate.

While not intending to be bound by theory, it is believed that excessive amounts of sulfate relative to carbonate may interfere with the builder performance of the crystalline calcium carbonate. Preferably, if sodium carbonate is included in the detergent composition, it is included preferably in a weight ratio of about 1:1 to about 20:1, more preferably from about 1:1 to about 10:1, most preferably from about 1:1 to about 5:1 of sodium carbonate to crystalline calcium carbonate builder. Additionally or in the alternative, sodium carbonate is present in the detergent composition in an amount of from about 2% to about 80%, more preferably from about 5% to about 70%, and most preferably from about 10% to about 50% by weight of the detergent composition.

The crystalline calcium carbonate in accordance with the invention (FIG. 2) can be made in a variety of ways so long as the resulting crystal substantially has a rhombohedral crystalline structure with {1,0,−1,1} crystallographic indices. Preferably, the starting ingredient is crystalline calcium carbonate which does not have the aforementioned crystal structure. There are a multitude of possible starting crystalline calcium carbonates suitable for use in the process. By way of example, naturally occurring calcite such as the one depicted in FIG. 5 can be mined or commercially purchased and subjected to the process described hereinafter.

As used herein, the word "milling" means crushing, grinding or otherwise affecting the physical structure of the crystalline calcium carbonate. In a preferred embodiment, the process first involves feeding starting crystalline calcium carbonate into an apparatus having an internal chamber and air nozzles directed into the chamber. One convenient apparatus in which such milling can occur is an Alpine Fluid Bed Jet Mill (Model 100 AFG Fluid Bed Jet Mill commercially available from Hosokawa Micron-Alpine, Germany). Other suitable apparatus are commercially available from Hosokawa Micron-Alpine, Germany are sold under the trade names Table Top Roller Mill, Aeroplex, Ecoplex and Turboplex. In this step of the process, the starting crystalline calcium carbonate is milled in such apparatus by inputting and grinding with air at a pressure from about 1 bar to about 50 bar, more preferably from about 1.5 bar to about 10 bar, and most preferably from about 2.5 bar to about 5 bar. In this way, the starting crystalline calcium carbonate is converted to a rhombohedral crystalline structure with {1,0,−1,1 } crystallographic indices, thereby forming the detergent builder.

This selected milling process step in which the starting ingredient (e.g., calcite) is milled involves crushing and/or grinding the starting crystalline calcium carbonate such that it is cleaved to form the aforementioned crystalline calcite structure (FIG. 2). While not intending to be bound by theory, it is believed that the {1,0,−1,1} crystallographic indices define "low stress" planes of larger naturally occurring calcite along which cleavage can occur if milled with selected process parameters.

One or more auxiliary builders can be used in conjunction with the crystalline calcium carbonate builder described herein to further improve the performance of the detergent composition described herein. For example, the auxiliary builder can be selected from the group consisting of aluminosilicates, crystalline layered silicates, MAP zeolites, citrates, polycarboxylates, sodium carbonates and mixtures thereof. Other suitable auxiliary builders are described hereinafter.

Detergent Compositions

The detergent compositions produced by the process invention can contain all manner of organic, water-soluble detergent compounds, inasmuch as the builder material are compatible with all such materials. In addition to a detersive surfactant, at least one suitable adjunct detergent ingredient is preferably included in the detergent composition. The adjunct detergent ingredient is preferably selected from the group consisting of auxiliary builders, enzymes, bleaching agents, bleach activators, suds suppressers, soil release agents, brighteners, perfumes, hydrotropes, dyes, pigments, polymeric dispersing agents, pH controlling agents, chelants, processing aids, crystallization aids, and mixtures thereof. The following list of detergent ingredients and mixtures thereof which can be used in the compositions herein is representative of the detergent ingredients, but is not intended to be limiting.

Preferably, a detergent surfactant is used in all of the various process embodiments described herein. In particular, the surfactant in the agglomeration process described previously is preferably in the form of a viscous paste, although forms are also contemplated by the invention. This so-called viscous surfactant paste has a viscosity of from about 1,000 cps to about 100,000 cps, more preferably from about 5,000 cps to about 80,000 cps, and optionally, contains at least about 10% water, more preferably at least about 20% water. The viscosity is measured at 70° C. and at shear rates of about 10 to 100 $sec^{-1}$. Furthermore, the surfactant paste, if used, preferably comprises a detersive surfactant in the amounts specified previously and the balance water and other conventional detergent ingredients.

The surfactant itself, in the viscous surfactant paste or in any other form necessary for the processes herein, is preferably selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred.

Nonlimiting examples of the preferred anionic surfactants useful in the surfactant paste include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-{}_M^+)CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

Optionally, other exemplary surfactants useful in the paste of the invention include and $C_{10}$ –$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

It should be understood, however, that certain surfactants are less preferred than others. For example, the $C_{11}$–$C_{18}$ alkyl benzene sulfonates ("LAS") and the sugar based surfactants are less preferred, although they may be included in the compositions herein, in that they may interfere or otherwise act as a poison with respect to the builder material.

Adjunct Builders

Other suitable auxiliary builders are described hereinafter. Preferred adjunct builders include aluminosilicate ion exchange materials and sodium carbonate. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Adjunct Detergent Ingredients

The starting detergent materials in the present processes can include additional detergent ingredients and/or, any number of additional ingredients can be incorporated in the detergent composition during subsequent steps of the present process. These adjunct ingredients include other detergency builders, bleaches, bleach activators, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Although much less preferred, minor amounts of other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. If used, those preferred for low level use herein are the phosphates, carbonates, $C_{10-18}$ fatty acids, polycarboxylates, and mixtures thereof. Still others include sodium tripolyphosphate, tetrasodium pyrophosphate, citrate, tartrate mono- and di-succinates, and mixtures thereof (see below).

In comparison with soluble sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than soluble silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Although preferably omitted from the compositions, low levels of inorganic phosphate builders may be used which include sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Other less preferred examples of nonphosphorus, inorganic builders are tetraborate decahydrate and silicates having a weight ratio of SiO to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Although preferably used only at low levels (and more preferably omitted from the compositions), polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other polycarboxylates are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Still other polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLE I

This Example illustrates the process of the invention which produces free flowing, crisp, high density detergent composition. Two feed streams of various detergent starting ingredients are continuously fed, at a rate of 2800 kg/hr, into a Lödige CB-30 mixer/densifier, one of which comprises a surfactant paste containing surfactant and water and the other stream containing starting dry detergent material containing a crystalline calcium carbonate (rhombohedral {1,0,−1,1}) and sodium carbonate. The rotational speed of the shaft in the Lödige CB-30 mixer/densifier is about 1400 rpm and the mean residence time is about 10 seconds. The contents from the Lödige CB-30 mixer/densifer are continuously fed into a Lödige KM 600 mixer/densifer for further agglomeration during which the mean residence time is about 2–3 minutes. The resulting detergent agglomerates are then fed to a fluid bed dryer and then to a fluid bed cooler, the mean residence time being about 10 minutes and 15 minutes, respectively. A coating agent, crystalline calcium carbonate (rhombohedral {1,0,−1,1}), is fed about midway down the moderate speed mixer/densifier 16 to control and prevent over agglomeration. The detergent agglomerates are then screened with conventional screening apparatus resulting in a uniform particle size distribution. The composition of the detergent agglomerates exiting the fluid bed cooler is set forth in Table I below:

TABLE I

| Component | % Weight of Total Feed |
|---|---|
| $C_{14-15}$ alkyl sulfate/$C_{14-15}$ alkyl ethoxy sulfate (EO = 0.6) | 31.4 |
| Calcite (rhombohedral, {1,0,−1,1}) | 46.1 |
| Sodium carbonate | 18.9 |
| Polyethylene glycol (MW 4000) | 1.4 |
| Misc. (water, etc.) | 2.2 |
| | 100.0 |

Additional detergent ingredients including perfumes, enzymes, and other minors are sprayed onto the agglomerates described above in the finishing step to result in a finished detergent composition. The relative proportions of the overall finished detergent composition produced by the process of instant process is presented in Table II below:

TABLE II

| Component | (% weight) A |
|---|---|
| $C_{14-15}$ alkyl sulfate/$C_{14-15}$ alkyl ethoxy sulfate (EO = 0.6) | 16.3 |
| Neodol 23-6.5[1] | 3.0 |
| $C_{12-14}$ N-methyl glucamide | 0.9 |
| Polyacrylate (MW = 4500) | 1.0 |
| Polyethylene glycol (MW = 4000) | 1.2 |
| Sodium Sulfate | 8.9 |
| Calcite (rhombohedral, {1,0,−1,1}) | 26.3 |
| Sodium carbonate | 27.2 |
| Protease enzyme | 0.4 |
| Amylase enzyme | 0.1 |
| Lipase enzyme | 0.2 |
| Cellulase enzyme | 0.1 |
| Minors (water, perfume, etc.) | 14 4 |
| | 100.0 |

[1]$C_{12-13}$ alkyl ethoxylate (EO=6.5) commercially available from Shell Oil Company.

The density of the resulting detergent composition is 796 g/l, the median particle size is 613 microns.

EXAMPLE II

This Example illustrates another process in accordance with the invention in which the steps described in Example I are performed except the coating agent, crystalline calcium carbonate (rhombohedral, {1,0,−1,1}), is added after the fluid bed cooler as opposed to in the moderate speed mixer/densifier. The composition of the detergent agglomerates exiting the fluid bed cooler after the coating agent is added is set forth in Table III below:

TABLE III

| Component | % Weight of Total Feed |
|---|---|
| $C_{14-15}$ alkyl sulfate/$C_{14-15}$ alkyl ethoxy sulfate (EO = 0.6) | 23.6 |
| $C_{12-13}$ linear alkylbenzene sulfonate | 7.8 |
| Calcite (rhombohedral, {1,0,−1,1}) | 46.1 |
| Sodium carbonate | 18.9 |
| Polyethylene glycol (MW 4000) | 1.4 |
| Misc. (water, perfume, etc.) | 2.2 |
| | 100.0 |

Additional detergent ingredients including perfumes, brighteners and enzymes are sprayed onto the agglomerates described above in the finishing step to result in a finished detergent composition. The relative proportions of the overall finished detergent composition produced by the process of instant process is presented in Table IV below:

TABLE IV

| Component | (% weight) A |
|---|---|
| $C_{12-16}$ linear alkylbenzene sulfonate | 9.0 |
| $C_{14-15}$ alkyl sulfate/$C_{14-15}$ alkyl ethoxy sulfate (EO = 0.6) | 7.3 |

TABLE IV-continued

| Component | (% weight) A |
|---|---|
| Neodol 23-6.5[1] | 3.0 |
| $C_{12-14}$ N-methyl glucamide | 0.9 |
| Polyacrylate (MW = 4500) | 1.0 |
| Polyethylene glycol (MW = 4000) | 1.2 |
| Sodium Sulfate | 8.9 |
| Calcite (rhombohedral, {1,0,−1,1}) | 26.3 |
| Sodium carbonate | 27.2 |
| Protease enzyme | 0.4 |
| Amylase enzyme | 0.1 |
| Lipase enzyme | 0.2 |
| Cellulase enzyme | 0.1 |
| Minors (water, perfume, etc.) | 14.4 |
| | 100.0 |

[1]$C_{12-13}$ alkyl ethoxylate (EO=6.5) commercially available from Shell Oil Company.

The density of the resulting detergent composition is 800 g/l, the median particle size is 620 microns.

EXAMPLE III

Calcium Sequestration and Rate of Sequestration Test

The following illustrates a step-by-step procedure for determining the amount of calcium sequestration and the rate thereof for the builder material used in the compositions described herein.

1. Add to 750 ml of 35° C. distilled water, sufficient water hardness concentrate to produce 171 ppm of CaCO3;
2. Stir and maintain water temperature at 35° C. during the experiment;
3. Add 1.0 ml of 8.76% KOH to the water;
4. Add 0.1085 gm of KCl;
5. Add 0.188 gm of Glycine;
6. Stir in 0.15 gm of $Na_2CO_3$;
7. Adjust pH to 10.0 using 2N HCl and maintain throughout the test;
8. Stir in 0.15 gm of a builder according the invention and start timer;
9. Collect an aliquot of solution at 30 seconds, quickly filter it through a 0.22 micron filter, quickly acidify it to pH 2.0–3.5 and seal the container;
10. Repeat step 9 at 1 minute, 2 minutes, 4 minutes, 8 minutes, and 16 minutes;
11. Analyze all six aliquots for $CaCO_3$ content via ion selective electrode, titration, quantitative ICP or other appropriate technique;

12. The Sequestration rate in ppm $CaCO_3$ sequestered per 200 ppm of builder is 171 minus the $CaCO_3$ concentration at one minute;

13. Amount of sequestration (in ppm $CaCO_3$ per gram/liter of builder) is 171 minus the $CaCO_3$ concentration at 16 minutes times five.

For the builder material particle sizes according to the instant invention which are on the low end of the particle size range, a reference sample is needed which is run without hardness in order to determine how much of the builder passes through the filter. The above calculations should then be corrected to eliminate the contribution of the builder to the apparent calcium concentration.

EXAMPLES IV–VI

Several detergent compositions made in accordance with the invention and specifically for top-loading washing machines are exemplified below. The base granule is prepared by a conventional spray drying process in which the starting ingredients are formed into a slurry and passed though a spray drying tower having a counter current stream of hot air (200–300° C.) resulting in the formation of porous granules. The admixed agglomerates are formed from two feed streams of various starting detergent ingredients which are continuously fed, at a rate of 1400 kg/hr, into a Lödige CB-30 mixer/densifier, one of which comprises a surfactant paste containing surfactant and water and the other stream containing starting dry detergent material containing aluminosilicate and sodium carbonate. The rotational speed of the shaft in the Lödige CB-30 mixer/densifier is about 1400 rpm and the mean residence time is about 1–10 seconds. The contents from the Lödige CB-30 mixer/densifier are continuously fed into a Lödige KM-600 mixer/densifier for further agglomeration during which the mean residence time is about 6 minutes. The resulting detergent agglomerates are then fed to a fluid bed dryer and to a fluid bed cooler before being admixed with the spray dried granules. The remaining adjunct detergent ingredients are sprayed on or dry added to the blend of agglomerates and granules.

| | IV | V | VI |
|---|---|---|---|
| Base Granule | | | |
| Calcite (rhombohedral, {1,0,−1,1}) | 3.0 | 16.0 | 11.0 |
| Aluminosilicate | 15.0 | 2.0 | 11.0 |
| Sodium sulfate | 10.0 | 10.0 | 19.0 |
| Sodium polyacrylate polymer | 1.0 | 1.0 | 1.0 |
| PolyethyleneGlycol (MW = 4000) | 2.0 | 2.0 | 1.0 |
| $C_{12-13}$ linear alkylbenzene sulfonate, Na | 6.0 | 6.0 | 7.0 |
| $C_{14-16}$ secondary alkyl sulfate, Na | 3.0 | 3.0 | 3.0 |
| $C_{14-15}$ alkyl ethoxylated sulfate, Na | 3.0 | 3.0 | 9.0 |
| Sodium silicate | — | — | 0.1 |
| Brightener 24[6] | 0.3 | 0.3 | 0.3 |
| Sodium carbonate | 7.0 | 7.0 | 25.7 |
| DTPA [1] | 0.5 | 0.5 | — |
| Admixed Agglomerates | | | |
| $C_{14-15}$ alkyl sulfate, Na | 5.0 | 5.0 | — |
| $C_{12-13}$ linear alkylbenzene sulfonate, Na | 2.0 | 2.0 | — |
| Calcite (rhombohedral, {1,0,−1,1}) | — | 7.0 | — |
| Sodium Carbonate | 4.0 | 4.0 | — |
| PolyethyleneGlycol (MW = 4000) | 1.0 | 1.0 | — |
| Admix | | | |
| $C_{12-15}$ alkyl ethoxylate (EO = 7) | 2.0 | 2.0 | 0.5 |
| Perfume | 0.3 | 0.3 | 1.0 |
| Polyvinylpyrrilidone | 0.5 | 0.5 | — |

-continued

| | IV | V | VI |
|---|---|---|---|
| Polyvinylpyridine N-oxide | 0.5 | 0.5 | — |
| Polyvinylpyrrolidone-polyvinylimidazole | 0.5 | 0.5 | — |
| Distearylamine & Cumene sulfonic acid | 2.0 | 2.0 | — |
| Soil Release Polymer [2] | 0.5 | 0.5 | — |
| Lipolase Lipase (100.000 LU/I)[4] | 0.5 | 0.5 | — |
| Termamyl amylase (60 KNU/g)[5] | 0.3 | 0.3 | — |
| CAREZYME ® cellulase (1000 CEVU/g)[4] | 0.3 | 0.3 | — |
| Protease (40 mg/g)[5] | 0.5 | 0.5 | 0.5 |
| NOBS[3] | 5.0 | 5.0 | — |
| Sodium Percarbonate | 12.0 | 12.0 | — |
| Polydimethylsiloxane | 0.3 | 0.3 | — |
| Miscellaneous (water, etc.) | balance | balance | balance |
| Total | 100.0 | 100.0 | 100.0 |

[1]Diethylene Triamine Pentaacetic Acid
[2]Made according to U.S. Pat. No. 5,415,807, issued May 16, 1995 to Gosselink et al
[3]Nonanoyloxybenzenesulfonate
[4]Purchased from Novo Nordisk A/S
[5]Purchased from Genencor
[6]Purchased from Ciba-Geigy

Having thus described the invention in detail, it will be clear to those skilled in the art that various changes may be made without departing from the scope of the invention and the invention is not to be considered limited to what is described in the specification.

What is claimed is:

1. A process for continuously preparing a detergent composition comprising the steps of:

(a) continuously mixing a detergent surfactant paste and dry starting detergent material into a high speed mixer/densifier to obtain detergent agglomerates, wherein the ratio of said surfactant paste to said dry detergent material is from about 1:10 to about 10:1, said dry detergent material containing a builder which is crystalline calcium carbonate substantially having a rhombohedral crystalline structure with {1,0,−1,1} crystallographic indices, having a median particle size of from about 0.2 to about 20 microns and having a surface area of from about 0.1 $m^2/g$ to about 4 $m^2/g$;

(b) mixing said detergent agglomerates in a moderate speed mixer/densifier to further density and agglomerate said detergent agglomerates; and (c) drying said detergent agglomerates in a fluid-bed dryer.

2. A process according to claim 1 wherein said dry starting material further contains an adjunct builder selected from the group consisting of aluminosilicates, crystalline layered silicates, sodium carbonate and mixtures thereof.

3. A process according to claim 1 wherein the density of said detergent composition is at least 650 g/l.

4. A process according to claim 1 further comprising the step of adding a coating agent after said moderate speed mixer/densifier.

5. A process according to claim 4 wherein said coating agent is selected from the group consisting of aluminosilicates, carbonates, silicates, said builder material, and mixtures thereof.

6. A process according to claim 1 wherein the mean residence time of said detergent agglomerates in said high speed mixer/densifier is in a range from about 2 seconds to about 45 seconds.

7. A process according to claim 1 wherein the mean residence time of said detergent agglomerates in said moderate speed mixer/densifier is in a range from about 0.5 minutes to about 15 minutes.

8. A process according to claim 1 wherein said crystalline calcium carbonate is calcite.

9. A process according to claim 1 wherein said ratio of said surfactant paste to said dry detergent material is from about 1:4 to about 4:1.

10. A process according to claim 1 wherein said surfactant paste has a viscosity of from about 1,000 cps to about 100,000 cps and comprises water and a surfactant selected from the group consisting of anionic, nonionic, zwitterionic, ampholytic and cationic surfactants and mixtures thereof.

11. A process for continuously preparing a detergent composition comprising the steps of:

(a) continuously mixing a detergent surfactant paste and a dry starting detergent material into a high speed mixer/densifier to obtain detergent agglomerates, wherein the ratio of said surfactant paste to said dry detergent material is from about 1:10 to about 10:1;

(b) mixing said detergent agglomerates in a moderate speed mixer/densifier to further densify and agglomerate said detergent agglomerates;

(c) drying said detergent agglomerates in a fluid-bed dryer; and (d) adding a coating agent to said detergent agglomerates so as to obtain a high density detergent composition having a density of at least 650 g/l; wherein said coating agent is a builder which is crystalline calcium carbonate substantially having a rhombohedral crystalline structure with {1,0,−1,1} crystallographic indices, having a median particle size of from about 0.25 to about 20 microns and having a surface area of from about 0.1 $m^2/g$ to about 4 $m^2/g$.

12. A process according to claim 11 wherein said adding step is completed in said moderate speed mixer/densifier.

13. A process according to claim 11 wherein said adding step is completed between said mixing step and said drying step.

* * * * *